United States Patent [19]

Inoue et al.

[11] 4,290,806

[45] Sep. 22, 1981

[54] COPPER ALLOY FOR RELIABLE ELECTRICAL CONNECTION

[75] Inventors: Sadao Inoue, Nikko; Tetsuya Umemura, Ichihara; Hiroshi Suzuki, Yokohama; Makoto Tago, Tokyo, all of Japan

[73] Assignee: Furukawa Metals Company, Ltd., Tokyo, Japan

[21] Appl. No.: 78,883

[22] Filed: Sep. 25, 1979

[30] Foreign Application Priority Data

Sep. 25, 1978 [JP] Japan ..... 53/117727

[51] Int. Cl.[3] ..... C22C 9/00

[52] U.S. Cl. ..... 75/153

[58] Field of Search ..... 75/153

[56] References Cited

U.S. PATENT DOCUMENTS 2,142,672 1/1939 Hensel et al. ..... 75/153

FOREIGN PATENT DOCUMENTS 2809561 9/1978 Fed. Rep. of Germany ..... 75/153

*Primary Examiner*—M. J. Andrews

*Attorney, Agent, or Firm*—Armstrong, Nikaido, Marmelstein & Kubovcik

[57] ABSTRACT

This invention relates to a copper alloy for reliable electrical connection comprising 0.5–3.0 wt% of Co, 0.03–0.4 wt% of P and the balance being composed of Cu and impurities thereof, which is characterized by that it excels in connecting characteristics relative to connection by compression and particularly does not permit a glow discharge and growth of cuprous oxide.

3 Claims, 6 Drawing Figures

COPPER ALLOY FOR RELIABLE ELECTRICAL CONNECTION

BACKGROUND OF THE INVENTION

This invention relates to a copper alloy for reliable electrical connection comprising 0.5–3.0 wt% preferably 0.6–2.3 wt% of Co, 0.03–0.4 wt% preferably 0.06–0.35 wt% of P and the balance being composed of Cu and unavoidable impurities contained in electrolytic copper, and furthermore relates to a reliable connecter and a reliable connecting method using a copper alloy thereof.

Figure 1:
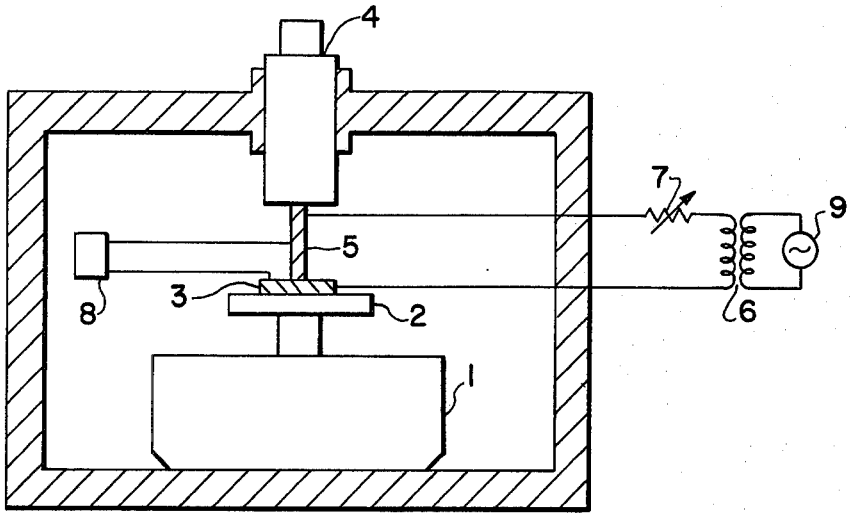
FIG. 1 is a schematic diagram showing a method for carrying out a test of glow discharge characteristic and growth of cuprous oxide.

A reference numeral 1 indicates a vibrator; 2 a vibrating plate; 3 a test piece; 4 a holding/loading device; 5 a copper wire, 8 a memoriscope; 9 a power source; 10 tightening connection pieces; 11 copper wire; 13 a power source; 16 a timer; and 17 a temperature measuring dotting recorder.

DESCRIPTION OF THE PRIOR ART

As to a copper alloy having excellent conductivity and machinability, German Patent Publication "Offenlegungsschrift" No. 2809561 discloses Cu—0.10–0.50 wt% Co—0.04–0.25 wt% P. However, the above patent publication does not refer to connecting ability in wiring of the said alloy. In fact, the alloy comprising less than 0.5 wt% of Co does not show improvement of glowing which is necessary for wire connecter.

Heretofore, copper or copper alloys have generally been used for wiring connection. However, it has been known that connected parts of wiring often deteriorate and generate heat during the use of wiring. It has been believed that such troubles are caused by decrease in contact pressure due to creep of the wire or a connecting part; increase in contact resistance which takes place as the contact pressure decreases; formation of an oxide film on the contact face which further increases the contact resistance; and then heat generation takes place due to Joule heat.

Therefore, for connection of wiring, it has been desired to use a material that excels in creep resistivity, oxidation resistivity and strength. In view of this, efforts have been exerted to develop materials that are capable of meeting such requirement. As a result, brass has come to be used in general while phosphor bronze has come to be used where especially high reliability is required. However, with brass or phosphor bronze used for wiring connection, it is hardly possible to retain the initial contact pressure applied in the beginning to the connection whatever structural arrangement may be contrived for the connection. Thus, the trouble of having heat generation has still frequently occurred. Therefore, there has arisen a demand for a wiring connecting part that is free from heat generation even under an imperfectly connected condition resulting from lowered contact pressure. Hence, many researches are now being conducted for such a connecting part in terms of materials as well as structural arrangement thereof.

Concerning glowing at an electrical connection and $Cu_2O$ growth therefrom, "NBSIR 76-1011, Exploratory Study of glowing Electrical Connections, by William Meese and Robert W. Beausoliel October 1976 Final Report" reports as follows: "This report describes and characterizes with quantifiable electrical and thermal measures the extent to which loose electrical connections in residential-type branch circuits have overheated in the laboratory. With loose electrical connections, which conceivably could be inadvertently duplicated in field installations, but with otherwise normal installation and operating conditions, visible glows have been ovserved under laboratory test conditions in nominal 120 volt, 15 and 20 ampere branch circuits with both copper and aluminum wire. Characteristics of the glow condition are differentiated from arcing/sparking as sometimes observed in making or breaking electric circuits.

"Glowing electrical connections may dissipate as much as 35 watts of power with a current of 15 amps in the circuit and as much as 5 watts with a current of 0.8 amp in the circuit. Temperatures over 750° F. were measured on the "break-off tab" of receptacles. Metal outlet boxes housing glowing connections in an insulated wall test set-up representative of a common type of residential construction attained temperatures in excess of 450° F. In laboratory tests under repetitive, intermittent and periodic cycles, a connection on a steel wire-binding screw of a receptacle open to the air had sustained glow conditions maintained for over 100 hours. Glowing connections will not perceptibly affect the electrical performance function of lights, appliances or other electrical loads, and will not "blow" fuses, trip circuit breaders or operate ground fault circuit interrupters."

As another report, "ELECTRICAL CONSTRUCTION AND MAINTENANCE February 1978 A McGRAW-HILL PUBLICATION" describes as follows: "Glowing electrical connections appear to be most likely at copper-steel or aluminum-steel interfaces. Many wiring devices have steel wire-binding screws. Glows may develop at such interfaces even when there appears to be physical contact between the wire and a brass plate on wiring devices."

SUMMARY OF THE INVENTION

The present inventors conducted studies of the deterioration and the heat generation that take place at connection parts of wiring to discover that: Even in cases where an imperfect connection results from creeping that takes place during the use of the wiring or from inadequate wiring connection work, heat generation not always takes place at such a connection. The heat generation takes place at the connection when external vibration or on and off of electric current supply causes the contact faces to move. This movement causes a glow discharge to take place at the contact faces. Then, the glow discharge brings about growth of cuprous oxide on the contact faces and this results in the heat generation. In other words, it is hardly possible to explain the cause for the heat generation by the conventional concept of the following mechanism:

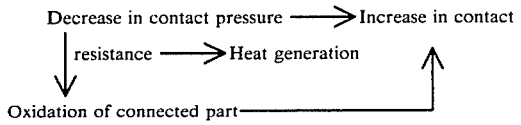

The inventors discovered that the heat generation takes place with the following factors involved in the mechanism:

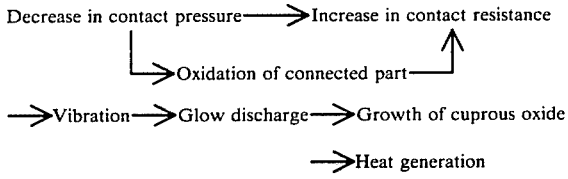

Next, the inventors studied the glow discharge and the growth of cuprous oxide which cause the heat generation. They found through these studies that: It was necessary for connecting electric wiring to use a material possessing a property of restraining a glow discharge from taking place (hereinafter will be called the glow discharge characteristic) and also a property of restraining cuprous oxide from growing (hereinafter will be called the cuprous oxide growth characteristic). In the conventionally used materials, these two characteristics are contradictory to each other. For example, pure copper excels in the glow discharge characteristic but is inferior in the cuprous oxide growth characteristic; and brass and phosphor bronze excel in the cuprous oxide growth characteristic but are inferior in the glow discharge characteristic.

The present inventors, therefore, conducted various studies for obtaining a material excelling in both of the two characteristics and thus developed a copper alloy containing 0.5–3.0% of Fe and 0.3–0.8% of Zn. These copper alloys had the same degree of the glow discharge characteristic as pure copper while they much excelled pure copper in the cuprous oxide growth characteristic. Through further studies, however, the inventors have found that the glow discharge characteristic has much greater effect on the heat generation at an imperfect connection than the effect of the cuprous oxide growth characteristic. In view of this finding, the inventors have developed a new copper alloy which has the same degree of the cuprous oxide growth characteristic as that of pure copper but excels pure copper by far in the glow discharge characteristic. The new copper alloy comprises 0.5–3.0% of Co, 0.03–0.4% of P and the rest Cu.

In the past, Cu-Co alloys were subjected to academic studies in connection with researches in aging of materials. However, these alloys have not been put in practical use, because Co is not only expensive but is inferior to Cu-Cr alloys, Cu-Zr alloys and Cu-Ag alloys in terms of aging hardening. The Cu-Co alloys have been also subjected to other studies in terms of strength and conductivity for possible use as conductive material. However, since they do not excel in this respect, they have been left unheeded. On the other hand, the present inventors have attempted to add various elements to Cu in their studies of the glow discharge characteristic and the cuprous oxide growth characteristic and have found that an alloy obtained by adding Co and P to Cu greatly excels in the glow discharge characteristic. The present invention is based on this finding.

It is therefore the general object of this invention to provide an alloy comprising 0.5–3.0% of Co, 0.03–0.4% of P and the rest Cu. The reasons for setting the addition quantity of Co at a value between 0.5 and 3.0% and that of P at a value between 0.05 and 0.4% are as follows: With Co added either in quantity less than 0.5% or in quantity exceeding 3%, the glow discharge characteristic will not be improved irrespective of addition of P and will become inferior to that of pure copper. Then, with P added in quantity less than 0.05%, the glow discharge characteristic will not be improved irrespective of addition of Co and will become inferior to that of pure copper. Further, when P is added in quantity exceeding 0.4%, not only the glow discharge characteristic will decrease but also the cuprous oxide growth characteristic will saliently degrade.

The above and further objects and novel features of the present invention will more fully appear from the following description of embodiment examples when the same is read in connection with the accompanying drawings.

DETAILED DESCRIPTION OF THE PREFERRED EMBODIMENTS

Example 1

Electrolytic copper (Cu 99.96, As 0.005, Bi 0.001, Pb 0.005, S 0.010, Fe 0.01 wt%) was melted in a graphite crucible. After Co and P were added thereto, the melted copper was cast into a metal mold to obtain an ingot measuring 60 mm in diameter. The outside of the ingot was ground. Then, the ingot is hot extruded into a shape measuring 40 mm in width and 8 mm in thickness. The alloy thus obtained was subjected to a heat treatment at 600° C. for 4 hours and then was cold rolled into a strip measuring 40 mm in width and 2 mm in thickness. The strips prepared in this manner were of compositions as shown in Table 1. Test pieces were cut from these strips. The surface of each test piece was polished with a No. 500 emery paper and washed with benzine. Then, the test pieces were subjected to tests to find the glow discharge and cuprous oxide growth characteristics of each of them. The results of tests were as shown in Table 1.

Figure 2:
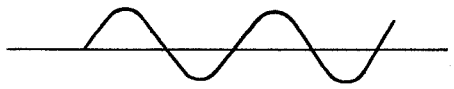
FIG. 2 is an illustration of a voltage wave form obtained in the glow discharge characteristic test under a normal connection condition.
Figure 3:
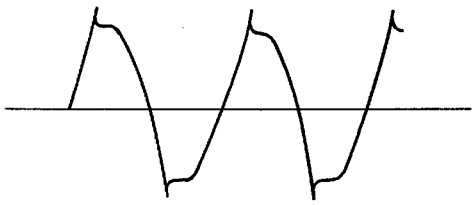
FIG. 3 is an illustration of a voltage wave form obtained when a glow discharge takes place.

The glow discharge characteristic and the cuprous oxide growth characteristic were obtained in the following manner:

Referring to FIG. 1 of the accompanying drawings, each of the above stated test pieces 3 was secured to a vibrating plate 2 attached to a vibrator 1. A copper wire 5 which was attached to a holding/loading device 4 was brought into pressed contact with the surface of the test piece 3. A voltage was impressed between the copper wire 5 and the test piece 3 by means of a SLIDARC 6 which was connected to a power source 9. A current which was thus arranged to flow was adjusted to 3 A by means of a variable resistor 7. Between the copper wire 5 and the test piece 3, there was provided a memoriscope 8 which was arranged to display voltage in a wave form. Under this condition, the vibrator 1 was operated to vibrate the vibrating plate 2 and the voltage between the copper wire 5 and the test piece 3 was observed at the memoriscope 8. In the accompanying drawings, FIG. 2 shows a voltage wave form displayed under a normal connection condition and FIG. 3 shows a voltage wave form displayed when a glow discharge took place. When there took place a glow discharge at the connection part, the voltage wave form displayed at the memoriscope 8 changed from the wave form shown in FIG. 2 to the wave form shown in FIG. 3. Then, the number of vibration registered at this point of time is obtained as the glow discharge characteristic. Concurrently with the occurrence of the glow discharge, the vibrating operation was stopped and the growth of cuprous oxide was allowed to proceed. Then, 60 minutes after the ceasing of vibration, the test piece 3 was taken out. The cuprous oxide which was thus allowed to grow was completely removed from the test piece 3 to measure decrease in the weight of the test piece 3. The value of decrease in the weight of the test piece thus measured was considered the cuprous oxide growth characteristic.

Further, other test pieces were also cut from the above stated rolled plates and were prepared to measure 10 mm in width and 100 in length and the conductivity and the tensile strength of these test pieces were measured. The results of measurement were as shown in Table 1.

As apparent from Table 1, all of the alloys of the present invention equal Cu in the cuprous oxide growth characteristic and much excel Cu in the glow discharge characteristic. Whereas, the comparison alloy No. 15 which has Co added in less quantity and the comparison alloy No. 16 which has Co added in larger quantity, the comparison alloy No. 13 which has P added in less quantity and the comparison alloy No. 14 which has P added in larger quantity are inferior to Cu (represented by the conventional alloy No. 17) in the glow discharge characteristic. Those alloys that have Co added in larger quantity are inferior to Cu in the cuprous oxide growth characteristic. Therefore, the glow discharge characteristic can be greatly enhanced without impairing the cuprous oxided growth characteristic of Cu by confining the addition quantities of Co and P to a prescribed range.

TABLE 1

| Alloy No. | Composition of alloy (%) Co | P | Zn | Cu | General characteristic: Tensile strength kg/mm² | Conductivity % IACS | Connection characteristics: Glow discharge charact'tic (cycles) | Cuprous oxide growth charac'tic (mg/hr) |
|---|---|---|---|---|---|---|---|---|
| Invented alloys: | | | | | | | | |
| 1 | 1.5 | 0.06 | — | The rest | 49.2 | 65.1 | $9.5 \times 10^4$ | 203 |
| 2 | " | 0.09 | — | The rest | 48.9 | 65.3 | $1.8 \times 10^5$ | 221 |
| 3 | " | 0.11 | — | The rest | 48.7 | 65.7 | $2.6 \times 10^5$ | 222 |
| 4 | " | 0.35 | — | The rest | 48.3 | 66.5 | $4.8 \times 10^5$ | 233 |
| 5 | 0.6 | 0.1 | — | The rest | 46.3 | 72.3 | $2.1 \times 10^5$ | 218 |
| 6 | " | 0.2 | — | The rest | 46.1 | 73.3 | $5.6 \times 10^5$ | 228 |
| 7 | 0.9 | 0.1 | — | The rest | 47.3 | 70.5 | $2.0 \times 10^5$ | 211 |
| 8 | " | 0.2 | — | The rest | 47.1 | 71.2 | $5.8 \times 10^5$ | 230 |
| 9 | 1.3 | 0.1 | — | The rest | 48.1 | 69.0 | $3.2 \times 10^5$ | 228 |
| 10 | " | 0.2 | — | The rest | 47.8 | 69.4 | $6.1 \times 10^5$ | 230 |
| 11 | 2.3 | 0.1 | — | The rest | 49.9 | 62.0 | $4.2 \times 10^5$ | 234 |
| 12 | " | 0.2 | — | The rest | 49.6 | 62.5 | $6.1 \times 10^5$ | 240 |
| Comparison alloys: | | | | | | | | |
| 13 | 1.3 | 0.02 | — | The rest | 48.9 | 68.0 | $8.6 \times 10^2$ | 50 |
| 14 | " | 0.8 | — | The rest | 45.8 | 71.2 | $9.2 \times 10^3$ | 296 |
| 15 | 0.3 | 0.2 | — | The rest | 47.2 | 75.9 | $9.6 \times 10^2$ | 236 |
| 16 | 4.0 | 0.2 | — | The rest | 54.4 | 52.2 | $2.6 \times 10^3$ | 281 |
| Conventional alloys: | | | | | | | | |
| 17 | — | — | — | 99.7 | 36.5 | 98.2 | $3.9 \times 10^4$ | 228 |
| 18 | — | — | 10 | The rest | 42.1 | 41.5 | $9.5 \times 10^2$ | 83 |
| 19 | — | — | 20 | The rest | 49.8 | 29.5 | $4.3 \times 10^2$ | 57 |
| 20 | — | — | 30 | The rest | 54.6 | 26.8 | $2.0 \times 10^2$ | 57 |

EXAMPLE 2

Figure 4A:
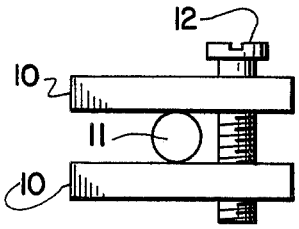
FIG. 4(*a*) is a side view showing a screw tightening type connecting part and FIG. 4(*b*) a plane view showing a tightening connection piece used in the connecting part.
Figure 4B:
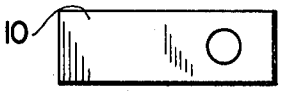
Figure 5:
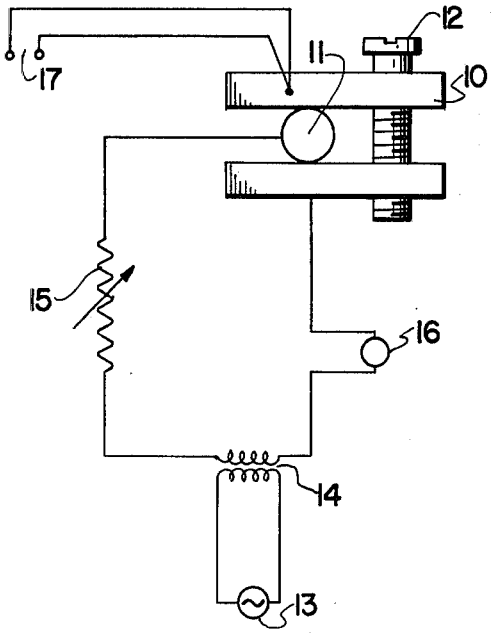
FIG. 5 is a schematic diagram illustration showing a method used for the current supplying test carried out on the screw tightening type connecting part.

A screw tightening type connecting part was prepared from each of the strips which were obtained in accordance with the procedures described in Example 1 measuring 40 mm in width and 2 mm in thickness. A copper wire measuring 2 mm in diameter was arranged to be held on both sides thereof by the above stated connecting part. Under this condition, these connecting parts were subjected to a test conducted with an electric current supplied thereto to obtain results as shown in Table 2. The test was conducted in the following manner:

As shown in FIG. 4(*b*), tightening pieces 10 were cut to measure 30 mm in length, 10 mm in width and 2 mm in thickness. The tightening pieces 10 were arranged to have the copper wire 11 of 2 mm diameter sandwitched in between them. The holding of the tightening pieces was tightened by a screw 12. Then, as shown in FIG. 5, a voltage was impressed between the copper wire 11 and the tightening pieces 10 from a power source 13 through a SLIDARC 14, a variable resistor 15 and a timer 16. Under this condition, a current of 30 A was intermittently supplied at intervals of 40 minutes. A temperature measuring dotting recorder 17 was arranged at one of the tightening pieces 10. The number of the connecting parts that generated heat of 300° C. and above after the intermittent current supply had been repeated 1000 cycles was examined for each of the alloys. In Table 2, each denominator indicates the number of the connecting parts subjected to the test and each numerator the number of connecting parts that generated the heat.

To prepare the tightening screws the hot rolled materials which were obtained in accordance with Example 1 were cut into a shape of 8 mm square. Each of the 8 mm square materials was processed into a shape measuring 4 mm in diameter through hard drawn and was finished by threading it. In the test, the tightening screws were tightened at tightening torque values of 1 kg-cm, 3 kg-cm and 8 kg-cm.

TABLE 2

| Alloy | No. | Number of connecting parts that reached 300° C. and above after intermittent supply of 3 A as been repeated 1000 times | | |
|---|---|---|---|---|
| | | 1 kg-cm | 3 kg-cm | 8 kg-cm |
| Invented alloy | 2 | 0/6 | 0/6 | — |
| | 4 | " | " | — |
| | 6 | " | " | — |
| | 7 | " | " | — |
| | 8 | " | " | — |
| | 9 | " | " | — |
| | 10 | " | " | — |
| | 12 | " | " | — |
| Comparison alloy | 13 | 4/6 | 2/6 | 0/6 |
| | 14 | 4/6 | 2/6 | " |

TABLE 2-continued

| Alloy | No. | Number of connecting parts that reached 300° C. and above after intermittent supply of 3 A as been repeated 1000 times | | |
|---|---|---|---|---|
| | | 1 kg-cm | 3 kg-cm | 8 kg-cm |
| | 15 | 4/6 | 1/6 | " |
| | 16 | 4/6 | 2/6 | " |
| Conventional alloy | 17 | 3/6 | 1/6 | " |
| | 20 | 5/6 | 1/6 | " |

As apparent from Table 2, none of the connecting parts made from the invented alloys had their temperature reach 300° C. even under the low tightening torque of 1–3 kg-cm. Whereas in the cases of the comparison alloys and the conventional alloys, the connecting parts made from them came to generate heat at the tightening torque of 3 kg-cm though they remained stable at the tightening torque of 8 kg-cm which represents a perfect connection condition. When contact pressure comes to decrease at a wiring connection either due to creep that takes place during the use of the wiring or due to inadequate installation work, the connection parts made from the invented alloys remains stable. Whereas, the connection parts made from the reference alloys and the conventional alloys become unstable and generate heat under such a condition. This advantage of the alloys of the present invention is believed to be attributable to their capability of restraining a glow discharge and heat generation from taking place even under a loosened tightening torque.

Further, it is essential for wiring connecting parts to have also a sufficient conductivity and a sufficient mechanical strength. However, as will be understood from Table 1, the alloys of the present invention excel brass, which has been conventionally employed, in conductivity and equal it in mechanical strength. The alloys of the present invention thus have excellent compression connecting characteristics and permit to obtain very stable compression type connecting parts which are saliently advantageous for industrial applications.

What is claimed is:

1. A copper alloy for giving a reliable connection in mechanical contact with an electric wire, which consists essentially of 0.6–3.9 wt. % of Co, 0.03–0.4 wt. % of P, the balance being composed of Cu and impurities thereof.

2. A copper alloy for giving a reliable connection in mechanical contact with an electric wire in accordance with claim 1 which consists essentially of 0.6–3.0 wt. % of Co, 0.06–0.35 wt % of P, the balance being composed of Cu and impurities thereof.

3. A copper alloy for giving a reliable connection in mechanical contact with an electric wire in accordance with claim 1 which consists essentially of 0.6–2.3 wt % of Co, 0.06–0.35 wt % of Co, 0.06–0.35 wt % of P, the balance being composed of Cu and impurities thereof.

* * * * *